US007234918B2

(12) United States Patent
Brillert et al.

(10) Patent No.: US 7,234,918 B2
(45) Date of Patent: Jun. 26, 2007

(54) GAP CONTROL SYSTEM FOR TURBINE ENGINES

(75) Inventors: Dieter Brillert, Orlando, FL (US); Wayne Giddens, Palm Beach Gardens, FL (US); Harald Hoell, Waechtersbach (DE); Robert W. Sunshine, Hobe Sound, FL (US); Juergen Hermeler, Haltern (DE); Hans-Thomas Bolms, Mülheim (DE)

(73) Assignee: Siemens Power Generation, Inc., Orlando, FL (US)

( * ) Notice: Subject to any disclaimer, the term of this patent is extended or adjusted under 35 U.S.C. 154(b) by 31 days.

(21) Appl. No.: 11/014,271

(22) Filed: Dec. 16, 2004

(65) Prior Publication Data

US 2006/0133927 A1 Jun. 22, 2006

(51) Int. Cl.
*F01D 11/08* (2006.01)

(52) U.S. Cl. ..... 415/173.5; 415/174.5

(58) Field of Classification Search ..... 415/173.5, 415/174.5

See application file for complete search history.

(56) References Cited

U.S. PATENT DOCUMENTS

| | | | | |
|---|---|---|---|---|
| 1,482,031 | A | | 1/1924 | Parsons et al. |
| 1,708,044 | A | | 4/1929 | Baumann |
| 1,823,310 | A | | 9/1931 | Allen |
| 1,895,003 | A | | 1/1933 | Meyer |
| 2,986,431 | A | | 5/1961 | Block et al. |
| 3,154,355 | A | | 10/1964 | McCafferty |
| 3,453,032 | A | | 7/1969 | Oberle |
| 4,035,041 | A | | 7/1977 | Larsson |
| 4,086,022 | A | | 4/1978 | Freeman et al. |
| 4,243,233 | A | | 1/1981 | Arai |
| 4,309,144 | A | | 1/1982 | Eggmann et al. |
| 4,320,903 | A | | 3/1982 | Ayache et al. |
| 4,513,975 | A | | 4/1985 | Hauser et al. |
| 4,544,285 | A | | 10/1985 | Shapiro et al. |
| 4,576,551 | A | | 3/1986 | Olivier et al. |
| 4,662,821 | A | | 5/1987 | Kervistin et al. |
| 4,714,406 | A | | 12/1987 | Hough |
| 4,815,931 | A | | 3/1989 | Linck et al. |
| 4,884,820 | A | * | 12/1989 | Jackson et al. ..... 277/415 |
| 4,915,510 | A | | 4/1990 | Arvidsson |
| 5,080,556 | A | * | 1/1992 | Carreno ..... 415/170.1 |

(Continued)

FOREIGN PATENT DOCUMENTS

DE 2357881 A1 5/1975

(Continued)

*Primary Examiner*—Hoang Nguyen

(57) ABSTRACT

Embodiments of the invention relate to a system and method for controlling the size of gaps in a turbine engine. In many instances, it is desirable to minimize the size of the gaps between neighboring rotating and stationary components in a turbine engine, such as between a disc cover plate and a proximate pre-swirler. According to embodiments of the invention, each component can be provided with a sealing surface. The sealing surfaces can be angled relative to the axis of rotation. The sealing surfaces are spaced from each other so as to form a gap therebetween. The sealing surfaces may or may not be substantially parallel. As a result of such configuration, the size of the gap can be controlled by axial and radial movement of the components. For example, the gap between the cover plate and the pre-swirler can be adjusted by axially movement of the rotor.

15 Claims, 6 Drawing Sheets

U.S. PATENT DOCUMENTS

| | | | | |
|---|---|---|---|---|
| 5,133,643 | A | 7/1992 | Ortolano | |
| 5,203,673 | A | 4/1993 | Evans | |
| 5,219,447 | A | 6/1993 | Arvidsson | |
| 5,222,742 | A * | 6/1993 | Roberts | 277/420 |
| 5,262,817 | A | 11/1993 | Krystal | |
| 5,290,144 | A | 3/1994 | Kreitmeier | |
| 5,330,320 | A | 7/1994 | Mansson | |
| 5,449,235 | A | 9/1995 | Buckmann | |
| 5,520,508 | A | 5/1996 | Khalid | |
| 5,593,278 | A | 1/1997 | Jourdain et al. | |
| 5,632,598 | A | 5/1997 | Maier | |
| 5,707,206 | A | 1/1998 | Goto et al. | |
| 5,775,873 | A | 7/1998 | Dalton et al. | |
| 5,795,073 | A | 8/1998 | Arvidsson et al. | |
| 5,971,710 | A * | 10/1999 | Stauffer et al. | 416/191 |
| 5,984,630 | A * | 11/1999 | Di Salle et al. | 415/174.5 |
| 6,102,655 | A | 8/2000 | Kreitmeier | |
| 6,164,655 | A * | 12/2000 | Bothien et al. | 277/303 |
| 6,238,179 | B1 * | 5/2001 | Wunderwald et al. | 415/110 |
| 6,267,553 | B1 | 7/2001 | Burge | |
| 6,315,301 | B1 | 11/2001 | Umemura et al. | |
| 6,331,097 | B1 | 12/2001 | Jendrix | |
| 6,450,760 | B1 | 9/2002 | Furukawa et al. | |
| 6,499,945 | B1 | 12/2002 | Lathrop | |
| 6,540,477 | B2 | 4/2003 | Glynn et al. | |
| 6,558,114 | B1 | 5/2003 | Tapley et al. | |
| 6,578,849 | B2 | 6/2003 | Haje | |
| 6,652,226 | B2 | 11/2003 | Albrecht, Jr. et al. | |
| 6,672,831 | B2 | 1/2004 | Brandl et al. | |
| 6,676,372 | B2 | 1/2004 | Scholz et al. | |
| 2002/0009361 | A1 | 1/2002 | Reichert et al. | |
| 2002/0172591 | A1 | 11/2002 | Glynn et al. | |

FOREIGN PATENT DOCUMENTS

| | | | |
|---|---|---|---|
| DE | 3926556 | A1 | 2/1991 |
| DE | 4223495 | A1 | 1/1994 |
| DE | 10059196 | A1 | 6/2002 |
| FR | 2722836 | A1 | 1/1996 |
| GB | 1485773 | | 9/1977 |
| GB | 2042086 | A | 9/1980 |
| JP | 2002529646 | | 9/2002 |
| SE | 502173 | C2 | 9/1995 |
| WO | WO 93/20335 | A1 | 10/1993 |
| WO | WO 00/28190 | A1 | 5/2000 |

* cited by examiner

GAP CONTROL SYSTEM FOR TURBINE ENGINES

FIELD OF THE INVENTION

The invention relates in general to turbine engines and, more specifically, to a system and method for minimizing gas leakage.

BACKGROUND OF THE INVENTION

Referring to FIGS. 1–2, the turbine section 10 of a turbine engine includes a rotor 12 having a longitudinal axis 14. A plurality of discs 16 (only one of which is shown) are provided on the rotor 12; the discs 16 are axially spaced from each other. A plurality of blades 18 (only one of which is shown) are mounted on each disc 16 to form a row of blades 18. The blades 18 are arrayed about the periphery of the disc 16 and extend radially outward therefrom.

Along the axial direction of the turbine 10, rows of blades 18 alternate with rows of stationary airfoils or vanes 20. Unlike the blades 18, the vanes 20 are attached at one end to a blade ring or casing 21 and extend radially inward therefrom to a radially inner end, referred to as an inner shroud 22. Any of a number of devices can be attached to the inner shroud 22. In the first row of vanes, for example, a pre-swirler 24 can extend from the inner shroud 22. Because the rows of stationary airfoils 20 and the rows of rotating airfoils 18 are spaced from each other, there are axial gaps 26 between these components.

In general, the turbine section 10 includes a radially outer region 28 and a radially inner region 30. Hot gases from the combustor section (not shown) of the engine are directed toward the radially outer region 28 of the turbine 10, which includes the alternating rows of stationary airfoils 20 and rotating airfoils 20. These components can withstand the high temperature of the combustion gases. In contrast, components in the radially inner region 30, such as the discs 16, can fail if exposed to the hot combustion gases. Accordingly, these components must be protected from the hot combustion gases. However, protecting the discs 16 and other components in the radially inner region 30 can be difficult because the axial gaps 26 provide a leak path for the hot gases to penetrate the radially inner region 30 of the turbine 10. While some leakage may be inevitable, there are various techniques for minimizing the amount of leakage or diminishing the severe consequences of such infiltration.

For instance, cold air can be used to block the radially inward progression of the hot gases. Cold air from the compressor section (not shown) of the engine can be provided to the radially inner region 30 to cool the components and to physically impede the progress of the hot gases from the radially outer region 28 to the radially inner region 30 of the turbine 10. In addition, the cold air can mix with the hot gases to reduce the temperature of the gases to a mixing temperature. In addition, the discs 16 can be shielded from the hot gases by a cover plate 32, also known as a ring segment, that is secured to the disc 16. The cover plate 32 can cover at least a portion of the disc 16. A cover plate 32 can be provided on the axial upstream face 34 of the disc 16 and/or on the axial downstream face 36 of the disc 16.

Another method of reducing hot gas flow into the radially inner region 30 of the turbine 10 is to make a tortuous flow path, such as by providing a labyrinth-type sealing system in the axial gaps 26. To that end, the cover plate 32 can provide one or more axially extending arms 38. Each arm 38 can have a sealing surface 40, as shown in FIG. 2. Similarly, the neighboring stationary component, such as the pre-swirler 24, can have a plurality of axially extending protrusions 42. Each protrusion 42 can have a sealing surface 44. The sealing surfaces 40 of the arms 38 and the sealing surfaces 44 of the protrusions 42 are spaced from and substantially parallel to each other to form an annular gap 46 therebetween. The sealing surfaces 40, 44 are substantially parallel to the longitudinal axis 14 of the rotor.

While it is preferred if the gap 46 between the sealing surfaces 46, 50 is as small as possible, the gap 46 cannot be entirely eliminated because, during transient conditions, such as engine startup or part load operation, the rotating parts (blades 18, rotor 12, and discs 16) and the stationary parts (blade rings, vanes 20, and components attached to the vane) thermally expand at different rates. Thus, the gap 46 between the sealing surfaces 40, 44 is based on the cold condition with an understanding of the thermal behavior of the turbine components during engine operation. Under some operating conditions, particularly at steady state, the gap 46 between the sealing surfaces 40, 44 can increase. The consequences of such an increase in the size of the gap 46 can vary depending on the location in the turbine. In some instances, a larger gap can result in a greater mass flow of hot gases into the radial inner region 30 of the turbine 10, thereby requiring additional cooling air to be supplied for purposes of blocking. In other instances, the mass flow of cooling air leaking into the radial outer region 28 of the turbine 10 may increase, thereby causing performance losses. In either case, there can be a decrease in the output and efficiency of the engine.

Because the gap 46 is formed by surfaces that are substantially parallel to the longitudinal axis 14 of the rotor 12, the size of the gap 46 can only be adjusted by radial movement of the cover plate 32 and the components operatively connected thereto or by radial movement of the vane 20 or any component attached to the vane 20, such as the pre-swirler 24. Achieving such radial movement is difficult during engine operation. Thus, there is a need for a system that allows for greater flexibility in controlling the size of such leakage gaps.

SUMMARY OF THE INVENTION

In one respect, embodiments of the invention are directed to a sealing system for a turbine engine. The system includes a turbine engine component that rotates about an axis of rotation. The rotating component has an axially extending arm providing a first surface. A stationary turbine engine component is disposed substantially proximate to the rotating component. The stationary component has an axially extending protrusion providing a second surface.

The first and second surfaces are angled relative to the axis of rotation. In one embodiment, the first and second surfaces can be angled from about 10 degrees to about 25 degrees relative to the axis of rotation. In another embodiment, the first and second surfaces can be angled from about 2 degrees to about 45 degrees relative to the axis of rotation. The first and second sealing surfaces can be angled relative to each other.

The first and second surfaces are spaced from each other so as to form a gap therebetween. The width of the gap is adjustable at least by relative axial movement between the rotating turbine engine component and the stationary turbine engine component to control radial leakage through the gap.

The rotating turbine engine component can have a second axially extending arm providing a third surface, and the stationary turbine component can have a second axially extending protrusion providing a fourth surface. The third and fourth surfaces can be spaced from each other so as to form a gap therebetween. The first and second arms on the rotating turbine engine component can be radially spaced from each other. Likewise, the first and second protrusions on the stationary turbine engine component can be radially spaced from each other.

The third and fourth surfaces can be angled relative to the axis of rotation. Thus, the width of the gap can be adjusted at least by relative axial movement between the rotating turbine engine component and the stationary turbine engine component. In one embodiment, the third and fourth surfaces can be angled from about 10 degrees to about 25 degrees relative to the axis of rotation. In another embodiment, the third and fourth surfaces can be angled from about 2 degrees to about 45 degrees relative to the axis of rotation. The third and fourth surfaces can be angled relative to each other.

The system can also include a rotor with a disc in which the rotor defines the axis of rotation. In such case, the rotating turbine engine component can be a disc cover plate secured to the disc so as to cover at least a portion of a disc.

Embodiments of another sealing system according to aspects of the invention can be applied to a spacer disc and a stationary vane housing. The spacer disc rotates about an axis of rotation. The spacer disc provides a first surface. The stationary vane housing is disposed substantially proximate to the spacer disc. The stationary component provides a second surface.

The first and second surfaces are angled relative to the axis of rotation, and the first and second sealing surfaces can be angled relative to each other. In one embodiment, the first and second surfaces can be angled from about 10 degrees to about 25 degrees relative to the axis of rotation. In another embodiment, the first and second surfaces can be angled from about 2 degrees to about 45 degrees relative to the axis of rotation. At least one seal can be provided on at least one of the first and second sealing surfaces. The first and second surfaces are spaced from each other so as to form a gap therebetween. Thus, the width of the gap is adjustable at least by axial movement of the spacer disc to control radial leakage through the gap.

Aspects of the invention also relate to a method of actively controlling a gap in a turbine engine. The turbine engine has a rotor that defines a longitudinal axis. The turbine also includes a rotating turbine engine component connected to the rotor. The rotating component provides a first surface. A stationary turbine engine component is disposed substantially proximate to the rotating component. The stationary component provides a second surface. The first and second surfaces are angled relative to the longitudinal axis. The first and second surfaces are spaced from each other so as to form a gap therebetween. Thus, the width of the gap is adjustable at least by axial movement of the rotating turbine engine component.

A method according to aspects of the invention involves operating the turbine engine. During operation of the turbine engine, the width of the gap is adjusted by moving the rotating turbine engine component along the longitudinal axis. The adjusting step can be performed during steady state or transient operation of the turbine engine. The adjusting step can include maintaining the width of the gap substantially constant at least during steady state operation of the turbine engine.

DETAILED DESCRIPTION OF THE INVENTION

Embodiments of the present invention address the shortcoming of prior sealing systems for turbine engines. According to embodiments of the invention, a rotating turbine engine component and a neighboring stationary turbine engine component can be configured to define a gap therebetween that can be adjusted by movement in at least two directions. Embodiments of the invention will be explained in the context of one possible system, but the detailed description is intended only as exemplary. Embodiments of the invention are shown in FIGS. 3–7, but the present invention is not limited to the illustrated structure or application.

Figure 1:
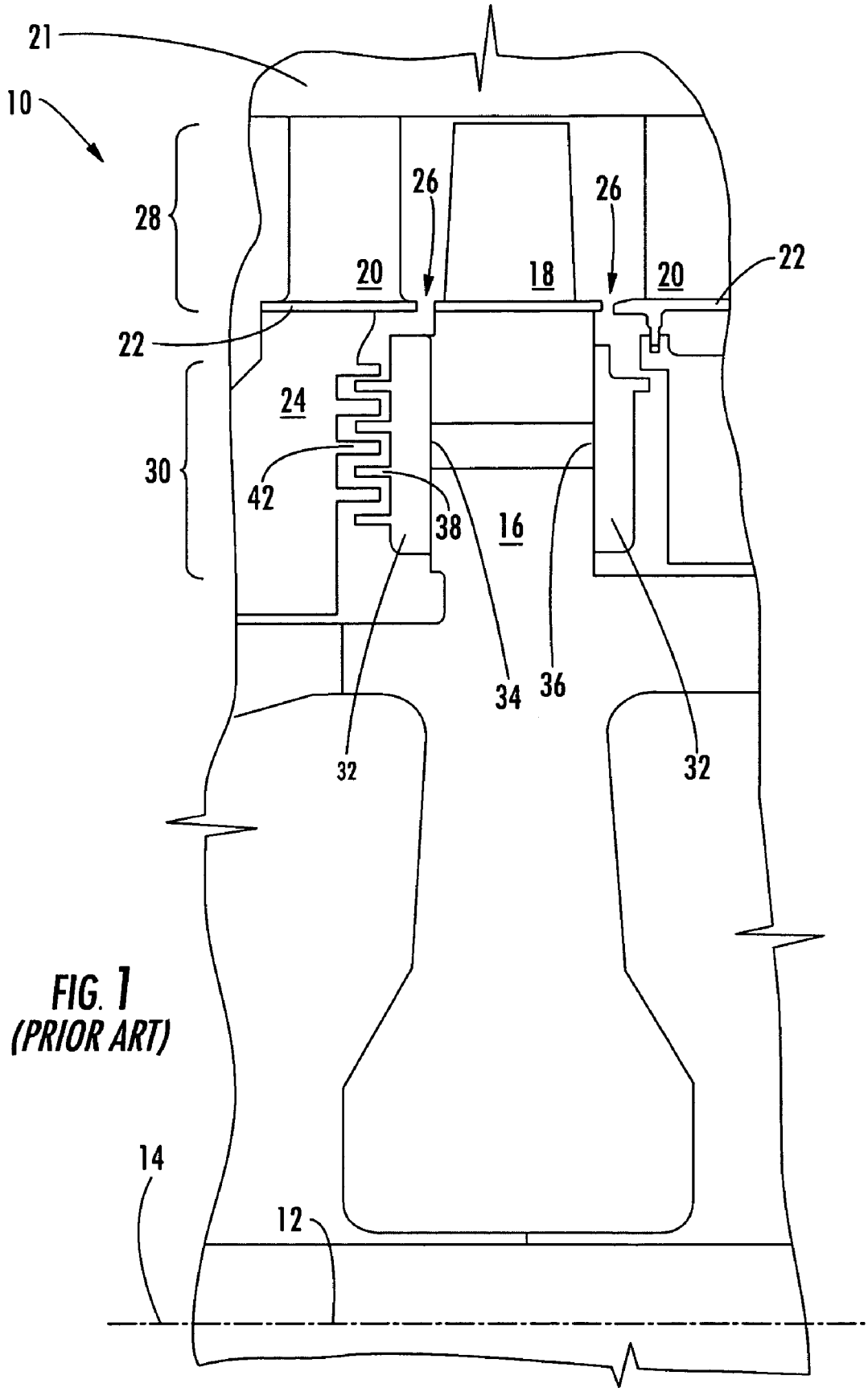
FIG. 1 (PRIOR ART)
FIG. 1 is a cross-sectional view of a portion of the turbine section of a prior turbine engine.
Figure 2:
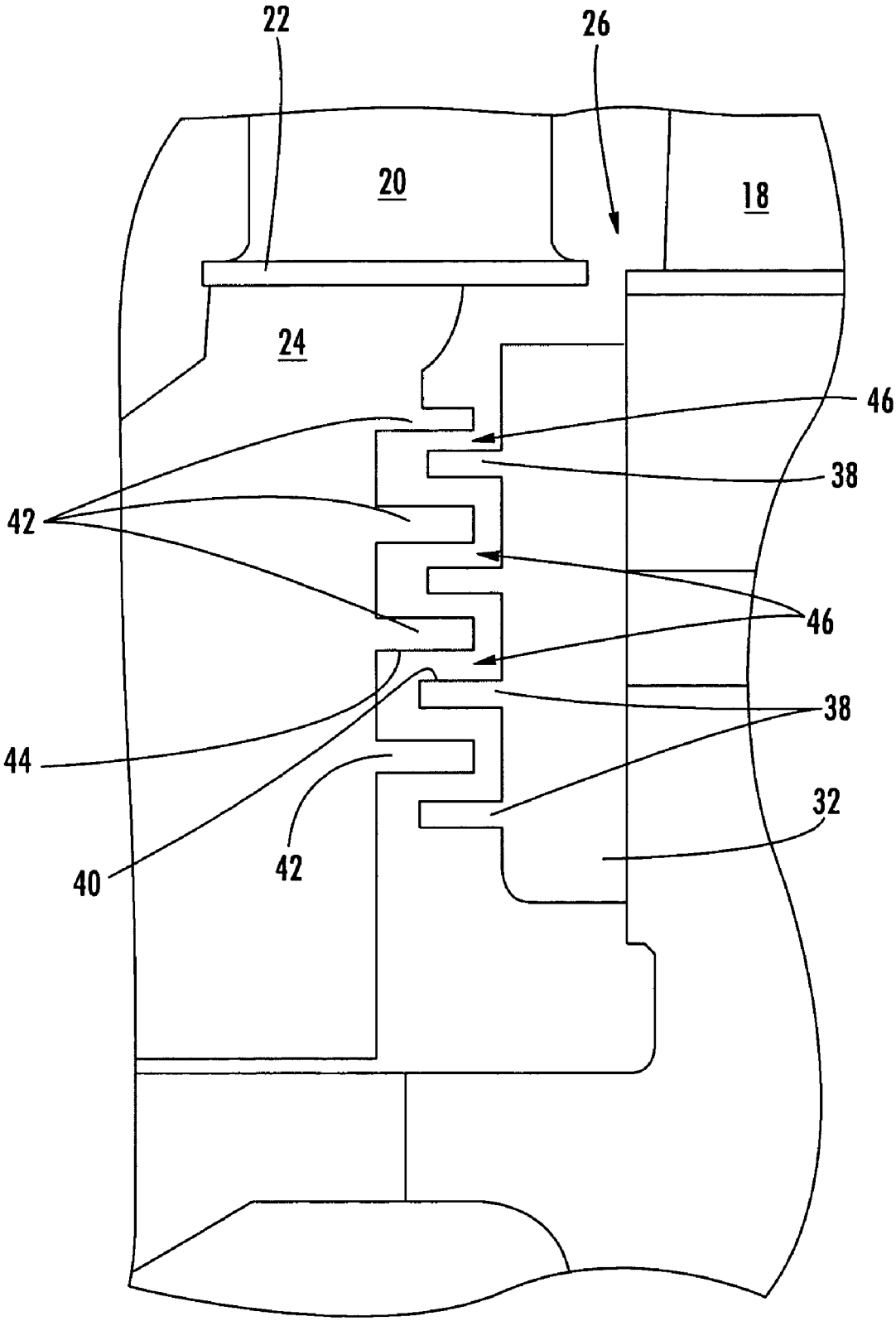
FIG. 2 (PRIOR ART)
FIG. 2 is a close up view of the interface between the axially extending arms of the disc cover plate and the axially extending protrusions of the pre-swirler in a prior turbine engine.
Figure 3:
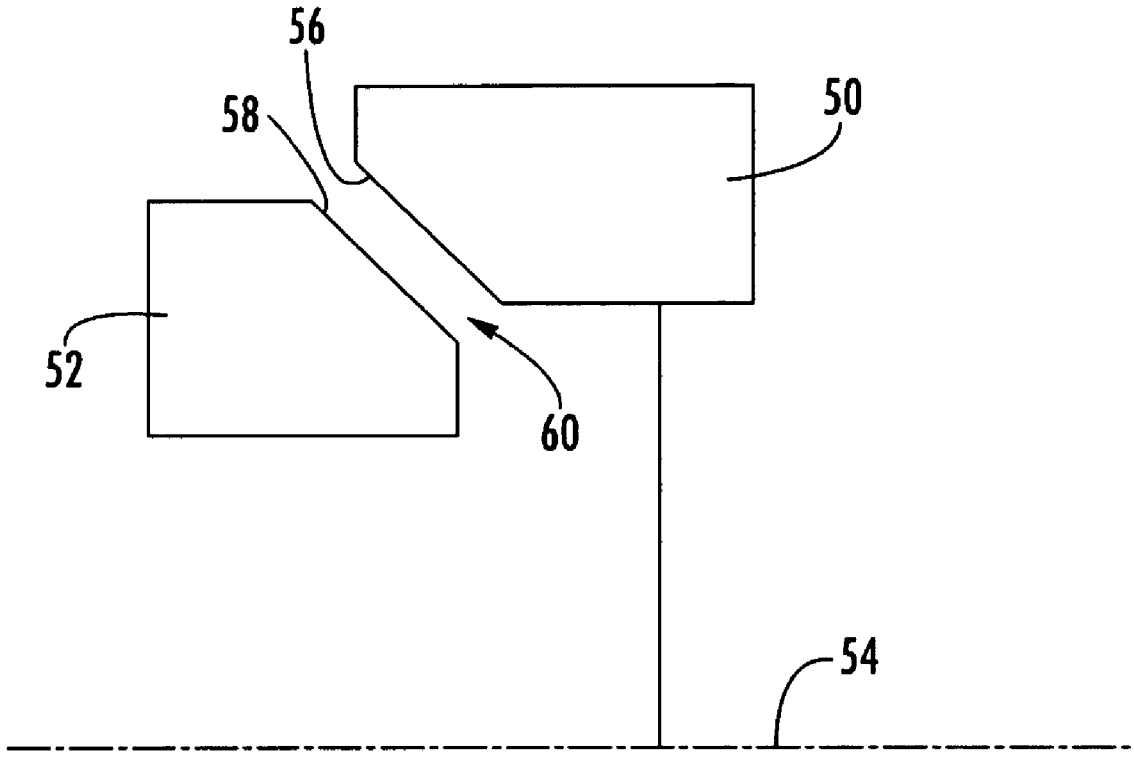
FIG. 3 is a partial diagrammatic view of a stationary turbine engine component and a substantially adjacent rotating turbine engine component having sealing surfaces configured according to embodiments of the invention.

Referring to FIG. 3, aspects of the invention can be applied to any neighboring rotating turbine engine component 50 and stationary turbine engine component 52 in which sealing is desired. The rotating turbine engine component 50 can have an associated axis of rotation 54

In one embodiment, the axis of rotation 54 can be defined by a rotor to which the rotating component 50 can be connected directly or indirectly. The rotating component 50 can provide a first sealing surface 56.

The stationary turbine component 52 can be substantially proximate to the rotating component 50. The stationary component 52 can be axially upstream or axially downstream of the rotating component 50. The stationary component 52 can provide a second sealing surface 58. The first and second sealing surfaces 56, 58 can be spaced apart so as to form a gap 60 therebetween. The first and second sealing surfaces 56, 58 can be angled relative to the axis of rotation 54. The first and second surfaces 56, 58 can extend at any angle relative to the axis of rotation 54; however, the first and second sealing surfaces 56, 58 are not substantially parallel with the axis of rotation 54. That is, the first and second sealing surfaces 56,58 do not extend at substantially 0 degrees or at substantially 180 degrees with respect to the axis of rotation 54.

Preferably, the first and second sealing surfaces 56, 58 are substantially parallel to each other. "Substantially parallel" is intended to mean true parallel and deviations therefrom up to a difference of about ten degrees between the angles at which the first and second sealing surfaces 56, 58 extend relative to the axis of rotation 54. However, in some instances, the difference between the angles at which the first and second sealing surfaces 56, 58 extend relative to the axis of rotation 54 can be greater than 10 degrees. There may be some benefits to providing first and second sealing surfaces 56, 58 that are not parallel to each other. For example, in instances where the first and second sealing surfaces 56, 58 come into contact, there would only be a line of contact or an otherwise relatively small area of contact between the sealing surfaces 56, 58 as opposed to contact across the entire surfaces 56, 58. As a result, wearing of the sealing surfaces 56, 58 can be reduced.

Because of such an arrangement, it will be appreciated that the size of the gap 60 can be adjusted by movement in two directions. Specifically, the size of the gap 60 can be adjusted not only by radial movement of the stationary and/or rotating components, but also by axial movement of these components as well.

Figure 4:
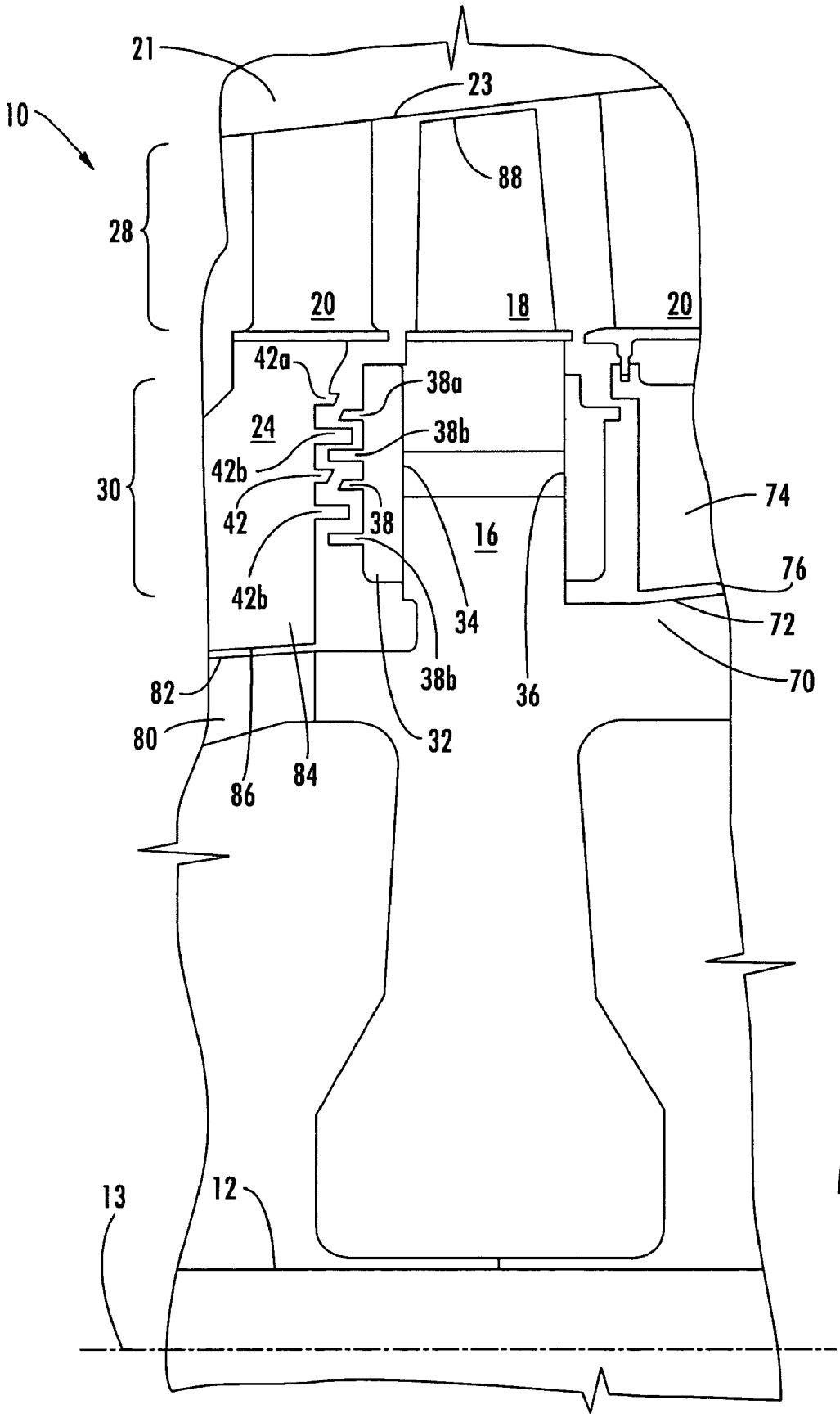
FIG. 4 is a cross-sectional view of a portion of the turbine section of a turbine engine configured with a sealing system in accordance with embodiments of the invention.

Embodiments of the invention can be applied in various places in a turbine engine. In one embodiment, the rotating component can be the cover plate 32 or ring segment for a turbine disc 16, as shown in FIG. 4. The cover plate 32 can be secured to the disc 16 in any of a number of ways including mechanical engagement. The disc 16 can have an axial upstream face 34 and an axial downstream face 36. The cover plate 32 can be provided on the disc 16 so as to cover at least a portion of one of these faces 34, 36. The cover plate 32 can be indirectly connected to the rotor 12 by way of the disc 16. The rotor 12 can have a longitudinal axis 13 which defines the axis of rotation.

As mentioned before, the cover plate 32 operates as a shield for at least a portion of the disc 16. The cover plate 32 can be provided in any of a number of forms. For instance, the cover plate 32 can be a continuous ring. Alternatively, the cover plate 32 can be made of several segments that are abutted so as to form a substantially continuous ring, or the cover plate 32 can include several segments that are not abutted so as to form gaps between the individual segments. Embodiments of the invention are not limited to any specific configuration for the cover plate 32. Further, it should be noted that while the term "plate" may connote a substantially flat sheet, embodiments of the invention are not limited to flat cover plates. Indeed, FIG. 4 provides an example of a cover plate 32 that is not substantially flat.

The cover plate 32 can provide a first sealing surface 62 in accordance with aspects of the invention. The sealing surface 62 can be located almost anywhere on the cover plate 32. In one embodiment, the cover plate 38 can have one or more axially extending arms 38. In such case, the first sealing surface 62 can be provided on at least one of the arms 38. Of course, it will be readily appreciated that the arms 38, like the cover plate 32, can be a continuous ring, made of several segments that are abutted so as to form a substantially continuous ring, or include several segments that are not abutted or otherwise connected, so as to form gaps between the individual segments.

The first sealing surface 62 can be substantially flat. Further, the first sealing surface 62 can extend at an angle relative to the longitudinal axis 13 of the rotor 12. Due to the high forces acting on the cover plate 32, it is preferred if the arm 38 and the first sealing surface 62 thereon are unitary with the cover plate 32 as opposed to being separate pieces joined together, but embodiments of the invention are not limited to such a construction. The cover plate 32 can be made of any of a number of materials including depending on the expected forces. For example, the cover plate 32 can be made of steel. The first sealing surface 62 can be provided on the cover plate 32 by any of a number of processes including machining.

A stationary turbine engine component can be disposed substantially proximate to the cover plate 32. For instance, in the first row of vanes 20, the stationary component can be a pre-swirler 24 attached to or supported by the inner shroud 22 of one or more of the vanes 20. The pre-swirler 24 can be fixed to the inner shroud 22 or it can be attached to allow some radial movement of the pre-swirler 24. Among other things, the pre-swirler 24 can provide cooling air to the blades and reduce the relative temperature of the cooling air. Again, the pre-swirler 24 is only provided as an example, and one skilled in the art will appreciate the other hardware that can be provided on the inner shroud 22 of the stationary airfoils 20. For example, the stationary component can also be a housing, a U-ring on the vane inner seal housing, a compressor exit diffuser or a compressor stator.

The pre-swirler 24 can be made of any of a number of materials including cast materials or cast steel. The pre-swirler 24 can provide a second sealing surface 64. The second sealing surface 64 can be located almost anywhere on the pre-swirler 24. In one embodiment, the pre-swirler 24 can have one or more axially extending protrusions 42. The protrusion 42 can extend in the opposite axial direction of the axially extending arms 38 on the cover plate 32. In such case, the second sealing surface 64 can be provided on at least one of the protrusions 42. The second sealing surface 64 can be substantially flat. Further, the second sealing surface 64 can extend at an angle relative to the longitudinal axis 13 of the rotor 12.

The first and second sealing surfaces 62, 64 can extend at various angles relative to the longitudinal axis 13 of the rotor 12. For example, the first and second sealing surfaces 62, 64 can extend anywhere from about 2 degrees to about 178 degrees relative to the axis of rotation. Preferably, the first and second sealing surfaces 62, 64 extend at an angle from about 2 degrees to about 45 degrees relative to the longitudinal axis 13 of the rotor 12. More preferably, the first and second sealing surfaces 62, 64 can extend from about 10 degrees to about 25 degrees relative to the longitudinal axis 13 of the rotor 12. The first and second sealing surfaces 62, 64 can be angled relative to each other.

When the cover plate 32 and the pre-swirler 34 are in their operational positions, the first and second sealing surfaces 62, 64 can be spaced from each other so as to define a gap 66 therebetween. The gap 66 between the first and second sealing surfaces 62, 64 is preferably as small as possible. In one embodiment, the spacing between the first and second sealing surfaces 62, 64 can be from about 0.5 millimeters to about 1.0 millimeters. As will be more fully appreciated later, the fact that the sealing surfaces 62, 64 are provided at an angle relative to the longitudinal axis 13 of the rotor 12 allows two degrees of freedom in adjusting the size of the gap 66.

It should be noted that there can be any number of arms 38 extending from the cover plate 32 and any number of protrusions 42 extending from the pre-swirler 24. These arms 38 and protrusions 42 can be configured in any of a number of ways. For example, the cover plate can include a second axially extending arm 38*a* having a third sealing surface 62*a*, and the pre-swirler 24 can have a second axially extending protrusion 42*a* having a fourth sealing surface 64*a*. The first and second arms 38, 38*a* on the cover plate 32 can be radially spaced from each other; the first and second protrusions 64, 64*a* can be radially spaced from each other.

The third and fourth sealing surfaces 62*a*, 64*a* can be spaced from each other so as to form a gap 66*a* therebetween. Further, the third and fourth sealing surfaces 62*a*, 64*a* can be angled relative to the longitudinal axis 13 of the rotor 12. The third and fourth sealing surfaces 62*a*, 64*a* can have any of the angled relationships discussed above in connection with the first and second sealing surfaces 62, 64. In some instances, the third and fourth sealing surfaces 62*a*, 64*a* can extend relative to the longitudinal axis 13 at substantially the same angle as the first and second sealing surfaces 62, 64, but, they can also extend at different angles. Alternatively, the third and fourth sealing surfaces 62*a*, 64*a* can be substantially parallel to the longitudinal axis 13 of the rotor 12 (not shown).

Figure 5:
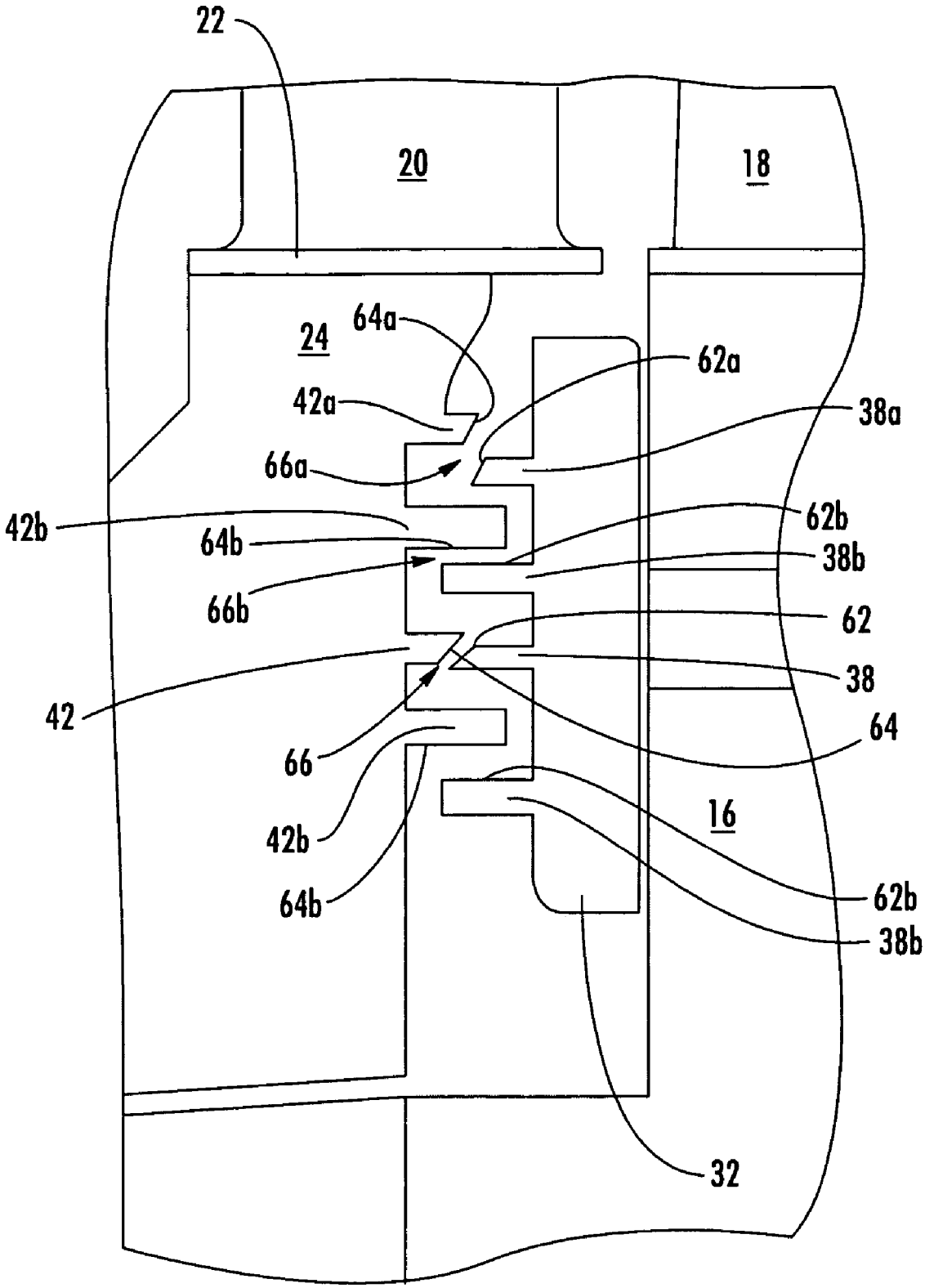
FIG. 5 is a close up view of an interface between an axially extending arm of the disc cover plate and an axially extending protrusion of the pre-swirler configured according to embodiments of the invention.

There can be still more axially extending arms 38*b* and protrusions 42*b* with sealing surfaces 62*b*, 64*b* that can be substantially parallel to the longitudinal axis 13 of the rotor 12, as shown in FIG. 5. Alternatively, the sealing surfaces 62*b*, 64*b* can be angled relative to the longitudinal axis 13 of the rotor 12 (not shown). The sealing surfaces 62*b*, 64*b* can be spaced from each other so as to form a gap 66*b* therebetween. The axially extending arms 38*b* can be radially spaced from the axially extending arm 38. Likewise, the axially extending protrusions 42*b* can be radially spaced from the axially extending protrusion 42.

It should be noted that FIGS. 4 and 5 show a sealing system with a total of four pairs of sealing surfaces; however, embodiments of the invention are not limited to any specific quantity of sealing surfaces. Further it should be noted that FIGS. 4 and 5 show two pairs of sealing surfaces in angled arrangements in accordance with aspects of the invention. However, in the case of multiple pairs of sealing surfaces, embodiments of the invention are not limited in application to any specific pair of sealing surfaces being configured with angled sealing surfaces according to aspects of the invention. Rather, angled arrangements can be applied to a single pair of sealing surfaces, every pair of sealing surfaces, or any combination of pairs of sealing surfaces between the pre-swirler 24 and the cover plate 32. FIGS. 4 and 5 show a system in which angled sealing surfaces alternate with sealing surfaces that are parallel with the longitudinal axis 13 of the rotor. Such an alternating pattern is provided merely as an example, and embodiments of the invention are not intended to be limited to such an arrangement.

As noted before, the cover plate 32 can be provided on the axial upstream face 34 of a disc 16. Likewise, the cover plate 32 can also be provided on the axial downstream side 36 of the disc 16. While embodiments of the invention can be applied to both sides 34, 36, it is preferred if the cover plate 32 according to embodiments of the invention is only provided on one side of the disc 16 to avoid complications during installation and disassembly.

Of the two sides 34, 36, it is preferred if the cover plate 32 according to embodiments of the invention is provided on the axial upstream side 34. The pressure of the cooling air is greater than the pressure of the hot gases on the axial upstream side 34. Thus, there is a greater tendency for the cooling air to seek out the radial outer region 28. However, a portion of the cold blocking air is also used to cool some of the internal portions of the blades. If there is a pressure relief path for the cool blocking air into the hot gas path, then the blade cooling supply pressure would decrease, resulting in a loss of cooling effectiveness and possibly hot gas ingress into the blades, which could result in failure of these parts. By providing the angled sealing surfaces according to aspects of the invention, the leakage and the associated disadvantages can be minimized.

While described above in connection with the cover plate 32 and a neighboring stationary component, such as a pre-swirler 24, embodiments of the invention can be provided in other areas of the turbine section 10. For instance, the rotating component can be a portion 70 of the disc 16. In such case, the portion 70 of the disc 16 can provide a sealing surface 72 that is angled relative to the longitudinal axis 13 of the rotor 12. An adjacent stationary part, such as a sealing housing 74, can also provide a sealing surface 76 that is angled relative to the longitudinal axis 13 of the rotor 12 in accordance with the invention.

Further, the sealing system according to the invention can be used to enhance interstage sealing. In such case, the rotating component can be a non-blade carrying disc 80, also known as a mini-disc or spacer disc. The spacer disc 80 can include a sealing surface 82 and a substantially adjacent portion of the pre-swirler 84 can include a sealing surface 86. The sealing surfaces 82, 86 can be angled relative to the longitudinal axis 13. The sealing surfaces 82, 86 can be provided with additional seals forming, for example, labyrinths or honeycombs.

It should be noted that FIG. 4 shows a spacer disc 80 in the first stage (first row of vanes 20 and first row of blades 18) of the turbine 10. Technically, this area would not be considered "interstage sealing" because it does not occur between two stages of the turbine 10. Nonetheless, it will readily be appreciated how this example of the sealing surfaces 82, 86 can be applied to the spacer discs that lie between two turbine stages. Again, the foregoing embodiments are just a few examples of substantially adjacent stationary and rotating components that can be configured according to embodiments of the invention.

It should be noted that when two or more pair of sealing surfaces are configured according to embodiments of the invention, one pair of sealing surfaces can extend at substantially the same angle relative to the axis of the rotor as another pair of sealing surfaces. Alternatively, one pair of sealing surfaces can extend at a different angle relative to the axis of rotation as another pair of sealing surfaces. For instance, referring to FIGS. 4 and 5, the pair of sealing surfaces 62, 64 and another pair of sealing surfaces 72, 76 can extend at substantially the same angle or at different angles relative to the longitudinal axis 13.

Further, it should be noted that the inner peripheral surface 23 of the blade ring or casing 21 can be angled relative to the longitudinal axis 13. Similarly, the tips 88 of the blades 18 can be angled relative to the longitudinal axis 13, preferably at substantially the same angle as the inner peripheral surface 23. In such case, any of the previously discussed sealing surfaces (62, 64, 72, 76, 82, 86) can be substantially parallel to the inner peripheral surface 23 and/or the blade tips 88.

One manner of using the above-described invention will now be described with reference to FIGS. 4–7. For purposes of this example, the cover plate 32 has three axially extending arms 38. Similarly, the pre-swirler has three axially extending protrusions 42. One arm 38 and protrusion 42 pair is configured with sealing surfaces 62, 64 in accordance with aspects of the invention. As the turbine is operated, the parts will heat up and thermally expand. Due to transient centrifugal forces on the rotor and the transient thermal behavior of the casing and the rotor and the components themselves, the gap 66 between the sealing surfaces 62, 64 may increase or decrease in size over time. Once steady state operation is achieved, the gap 66 may be larger than it was in the initial cold condition. As a result, the mass flow rate through the gap 66 will increase. In the case of the gap 66 upstream of a row of blades, the mass flow of cooling air from the radially inner region 30 into the radially outer region will increase because the cooling air supply pressure is greater than the pressure of the hot gas path. On the downstream side of a row of blades, the pressure of the hot gases is greater than the pressure of the cooling air supply; thus, hot gases can enter the radially inner region 30 of the turbine 10. As discussed earlier, neither situation is desirable.

The gap control system according to aspects of the invention allows the size of the gap 66 to be adjusted by moving one of the components in the axial direction, that is, substantially parallel to the longitudinal axis 13 of the rotor 12. Because the cover plate 32 is indirectly attached to the rotor 12, one way of achieving axial movement of the cover plate 32 is by axially moving the rotor 12. Axial movement of the rotor 12 can be achieved in a number of ways. Various examples are disclosed in U.S. Patent Application Publication No. 2002/0009361 A1, which is incorporated herein by reference.

Figure 6:
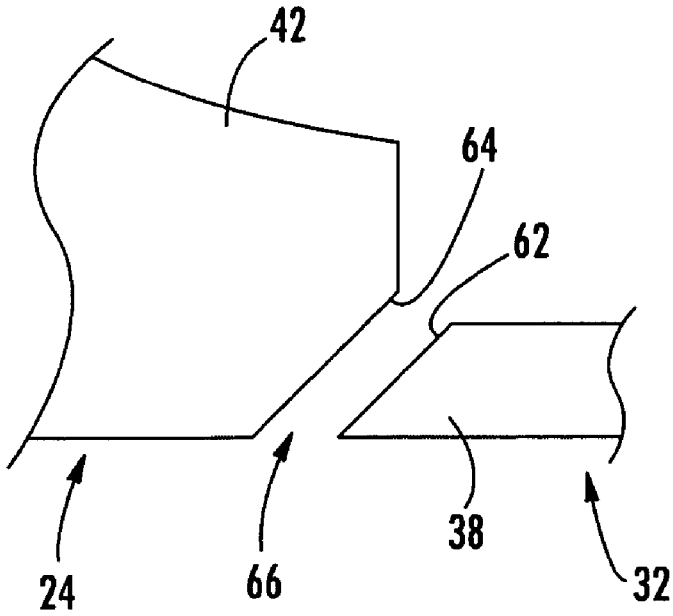
FIG. 6 is a cross-sectional close-up view of an axially extending arm of a disc cover plate and an axially extending protrusion of a pre-swirler configured according to embodiments of the invention, showing the sealing surfaces spaced apart.
Figure 7:
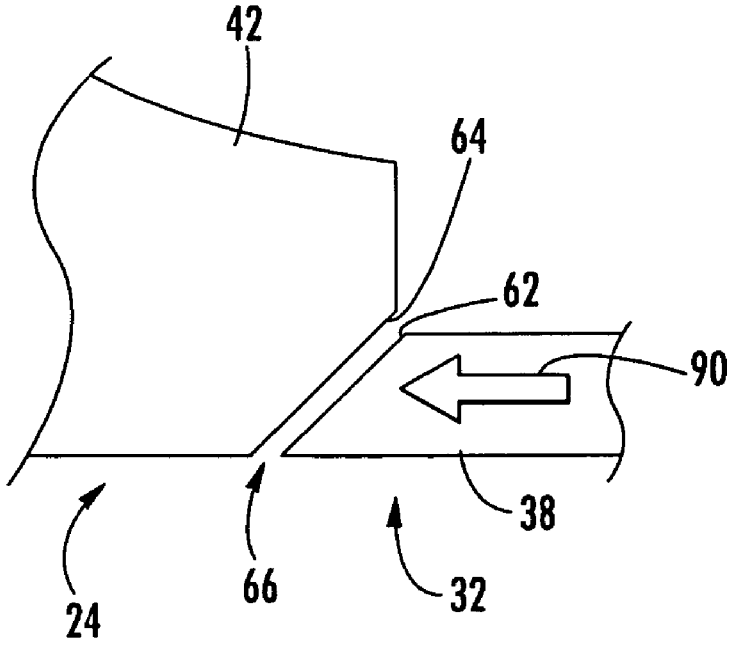
FIG. 7 is a cross-sectional close-up view of an axially extending arm of a disc cover plate and an axially extending protrusion of a pre-swirler configured according to embodiments of the invention, showing a reduction in the spacing between the sealing surfaces by axial movement of the disc cover plate.

For example, as shown in FIGS. 6 and 7, the gap 66 can be made smaller by moving the cover plate 32 in the axially upstream direction 90. Ideally, such movement is done during steady state operation of the engine; however, such movement can be done under transient conditions as well. The gap 66 can be adjusted as needed during all operating conditions. In some instances, it may be desirable to widen the gap 66 whereas in other circumstances it may be desirable to minimize the gap 66. In addition, the size of the gap 66 can be adjusted as needed so as to maintain a substantially constant spacing between the first sealing surface 62 on the arm 38 and the second sealing surface 64 on the protrusion 42. For those sealing surfaces 62*a*, 64*a* that are substantially parallel to the longitudinal axis 13 of the rotor 12, the axial movement of the rotor 12 will not affect the size of the gap 66*a*. Thus, it will now be appreciated that by providing sealing surfaces 62, 64 at angles relative to the axis of rotation 13, an additional degree of freedom—in the axial direction—becomes available for controlling the size of the gap 66. In the context of the gap 66 between the cover plate 32 and the pre-swirler 24, active gap control can reduce the amount of blocking air is needed, which, in turn, can lead to a higher output and efficiency of the turbine.

The foregoing description is provided in the context of one possible sealing system between stationary and rotating turbine engine components. While described in the context of the turbine section, embodiments of the invention can be applied to other portions of the engine as one skilled in the art would appreciate. Thus, it will of course be understood that the invention is not limited to the specific details described herein, which are given by way of example only, and that various modifications and alterations are possible within the scope of the invention as defined in the following claims.

What is claimed is:

1. A sealing system for a turbine engine comprising;

a rotating turbine engine component having an axis of rotation, the rotating component including first and second axially extending arms separated by a third axially extending arm, wherein the first axially extending arm provides a first surface and the second axially extending arm provides a third surface; and a stationary turbine engine component disposed substantially proximate to the rotating component, the stationary component including fourth and fifth axially extending arms separated by a sixth extending arm, wherein the fourth axially extending protrusion provides a second surface, wherein the first and second surfaces are angled relative to the axis of rotation and to each other, the first and second surfaces being axially opposed and axially spaced from each other so as to form a gap axially therebetween and the fifth axially extending arm provides a fourth surface, wherein the third and fourth surfaces are angled relative to the axis of rotation and to each other, the third and fourth surfaces being axially opposed and axially spaced from each other so as to form a gap axially therebetween, wherein third and sixth axially extending arms are generally parallel to each other, are offset radially from each other and extend axially past each other to form sealing surfaces on radial surfaces facing each other; wherein at least one of the rotating turbine engine component and the stationary turbine engine component is selectively axially movable, wherein the widths of the gaps are adjustable by selective axial movement of at least one of the rotating turbine engine component and the stationary turbine engine component, whereby leakage through the gaps is controlled.

2. The system of claim 1 wherein the first and second surfaces are angled from about 10 degrees to about 25 degrees relative to the axis of rotation.

3. The system of claim 1, wherein the first and second surfaces are angled from about 2 degrees to about 45 degrees relative to the axis of rotation.

4. The system of claim 1 further including a rotor with a disc, wherein the rotor defines the axis of rotation, wherein the rotating turbine engine component is a disc cover plate secured to the disc so as to cover at least a portion of a disc.

5. The system of claim 1 wherein the third and fourth surfaces are angled from about 10 degrees to about 25 degrees relative to the axis of rotation.

6. The system of claim 1 wherein the third and fourth surfaces are angled from about 2 degrees to about 45 degrees relative to the axis of rotation.

7. A sealing system for a turbine engine comprising:

a rotating spacer disc having an axis of rotation, the spacer disc being selectively axially movable, the spacer disc providing first and second axially extending arms separated by a third axially extending arm, wherein the first axially extending arm provides a first surface and the second axially extending arm provides a third surface;

a stationary vane housing disposed substantially proximate to the spacer disc, the stationary vane housing providing fourth and fifth axially extending arms separated by a sixth extending arm, wherein the forth axially extending protrusion provides a second surface, wherein the first and second surface are angled relative to the axis of rotation and to each other, and the fifth axially extending arm provides a fourth surface, wherein the third and fourth surfaces are angled relative to the axis of rotation and to each other, the third and fourth surface being axially opposed and axially spaced from each other so as form a gap axially therebetween, wherein third and sixth axially extending arms are generally parallel to each other, are offset radially from each other and extend axially past each other to form sealing surfaces on radial surfaces facing each other and between the first, second, third, and fourth axially extending arms; wherein the widths of the gaps are adjustable by selective axial movement of the spacer disc such that the first surface moves axially relative to the second surface and the fourth surface moves axially relative to the fifth surface, whereby leakage through the gaps is controlled.

8. The system of claim 7 wherein the first and second surfaces are angled from about 10 degrees to about 25 degrees relative to the axis of rotation.

9. The system of claim 7 wherein the first and second surfaces are angled from about 2 degrees to about 45 degrees relative to the axis of rotation.

10. The system of claim 7 wherein at least one seal is provided on one of the first and second surface.

11. The system of claim 7 further including a casing having an inner peripheral surface that is angled relative to the axis of rotation, wherein the casing encloses the rotating spacer disc and the stationary vane housing, and wherein the first and second surfaces are substantially parallel to the inner peripheral surface of the casing.

12. A method of active gap control in a turbine engine comprising the steps of:

(a) operating a turbine engine, the turbine engine including:

a rotor defining a longitudinal axis;

a rotating turbine engine component connected to the rotor, the rotating component providing first and second axially extending arms separated by a third axially extending arm, wherein the first axially extending arm provides a first surface and the second axially extending arm provides a third surface;

a stationary turbine engine component disposed substantially proximate to the rotating component, the stationary component providing fourth and fifth axially extending arms separated by a sixth extending arm, wherein the fourth axially extending protrusion provides a second surface, wherein the first and second surfaces are angled relative to the axis of rotation and to each other, and the fifth axially extending arm provides a fourth surface, wherein the third and fourth surface are angled relative to the axis of rotation and to each other, the third and fourth surfaces being axially opposed and axially spaced from each other so as to form a gap axially therebetween, wherein third and sixth axially extending arms are generally parallel to each other, are offset radially form each other and extend axially past each other to form sealing surfaces on radial surfaces facing each other and between the first, second, third, and fourth axially extending arms; whereby widths of the gaps are adjustable at least by axial movement of the rotating turbine engine component; and (b) adjusting the width of the gap by selectively moving the rotating turbine engine component along the longitudinal axis during operation of the turbine engine.

13. The method of claim 12 wherein the adjusting step is performed during steady state operation of the turbine engine.

14. The method of claim 12 wherein the adjusting step is performed during transient operation of the turbine engine.

15. The method of claim 12 wherein the adjusting step includes maintaining the width of the gap substantially constant at least during steady state operation of the turbine engine.

* * * * *